US012704043B1

(12) United States Patent
Williamson et al.

(10) Patent No.: US 12,704,043 B1
(45) Date of Patent: Aug. 11, 2026

(54) DOWNHOLE LINE RETENTION WITH AXIAL FLOW

(71) Applicant: Halliburton Energy Services, Inc., Houston, TX (US)

(72) Inventors: Edmund Christopher Williamson, Little Elm, TX (US); Stephen Michael Greci, Little Elm, TX (US); Ryan M. Novelen, Euless, TX (US); Nicholas A Kuo, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/229,890

(22) Filed: Jun. 5, 2025

(51) Int. Cl.
*E21B 40/00* (2006.01)
*E21B 43/10* (2006.01)

(52) U.S. Cl.
CPC ..... *E21B 40/001* (2020.05); *E21B 43/10* (2013.01)

(58) Field of Classification Search
CPC ..... E21B 17/026; E21B 17/1035
See application file for complete search history.

(56) References Cited

U.S. PATENT DOCUMENTS

| | | | | |
|---|---|---|---|---|
| 4,337,969 | A * | 7/1982 | Escaron | E21B 17/026 174/136 |
| 8,136,589 | B2 | 3/2012 | Holderman et al. | |
| 10,151,179 | B2 | 12/2018 | Greci et al. | |
| 2002/0053439 | A1* | 5/2002 | Danos | E21B 17/1035 166/227 |
| 2011/0297376 | A1* | 12/2011 | Holderman | E21B 17/1035 166/278 |
| 2012/0024545 | A1* | 2/2012 | Kuo | E21B 17/026 166/117.6 |
| 2014/0014373 | A1* | 1/2014 | Richards | E21B 17/1035 166/242.6 |
| 2015/0226023 | A1* | 8/2015 | Scruggs | E21B 47/07 166/308.1 |
| 2021/0123319 | A1* | 4/2021 | Greci | E21B 17/206 |
| 2023/0039223 | A1* | 2/2023 | Ortiz | F16B 7/182 |
| 2023/0349240 | A1* | 11/2023 | McLeary | E21B 17/1078 |
| 2024/0084647 | A1* | 3/2024 | Hammer | E21B 17/026 |
| 2025/0277420 | A1* | 9/2025 | El Mallawany | E21B 33/129 |
| 2025/0283381 | A1* | 9/2025 | Greci | E21B 17/026 |

* cited by examiner

*Primary Examiner* — Shane Bomar
(74) *Attorney, Agent, or Firm* — DeLizio, Peacock, Lewin and Guerra, LLP

(57) ABSTRACT

Some implementations include a downhole line capture device for use in a wellbore comprising a ring including one or more flutes configured to enable fluid to flow axially through an annular space between the ring and a tubular; and a line retainer coupled with the ring to capture a line running along an outer surface of the ring.

18 Claims, 7 Drawing Sheets

DOWNHOLE LINE RETENTION WITH AXIAL FLOW

TECHNICAL FIELD

Some implementations relate to downhole components. More specifically, some implementations relate to a downhole line capture device.

BACKGROUND

Various compeltion tools may be used during the completion phase of extracting hydrocarbons from a well. Producting tooling in a well may include tubing, screens, couplers, inflow control devices, cabling, and more. Better interoperabliity between these components may optimize the production process.

BRIEF DESCRIPTION OF THE DRAWINGS

Implementations of the disclosure may be better understood by referencing the accompanying drawings.

DESCRIPTION OF IMPLEMENTATIONS

The description that follows may include example systems, methods, techniques, and program flows that embody implementations of the disclosure. However, this disclosure may be practiced without these specific details. For clarity, some well-known instruction instances, protocols, structures, and techniques may not be shown in detail.

Overview

Figure 1:
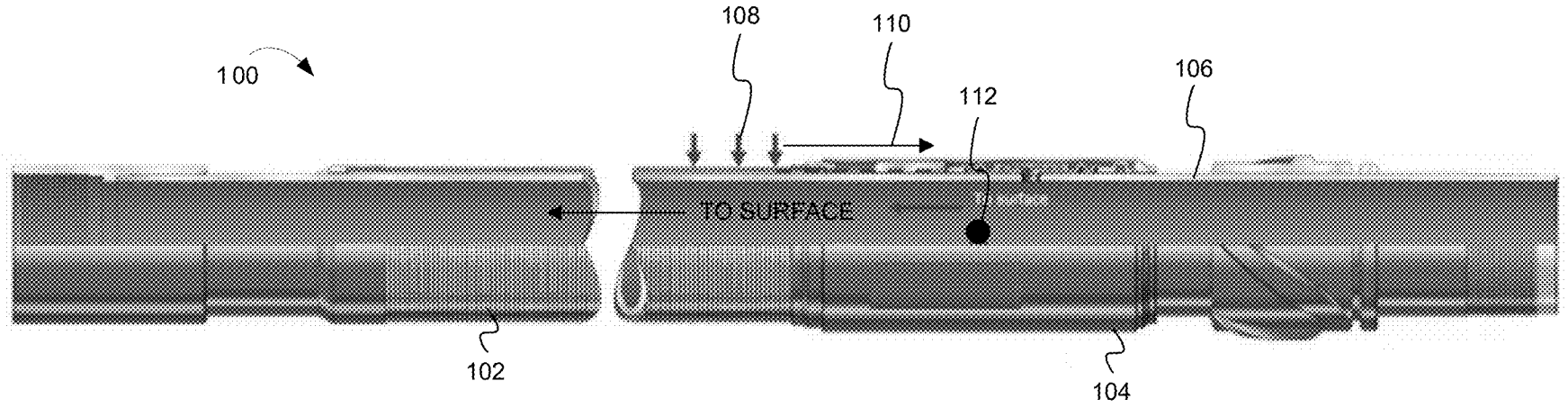
FIG. 1 is perspective view of a traditional completion string.

Traditionally, well operators utilize tubing, centralizers, screens, and inflow control devices (ICDs) in the various stages of a well. FIG. 1 is perspective view of a traditional completion string 100. In FIG. 1, a screen 102 resides around the outside of a tubing string 106. The screen 102 creates an annular space 108 between itself and the tubing string 106. Fluid may pass through the screen 102 into the annular space 108. The fluid may proceed through an ICD 104 and an orifice 112 into the tubing string 106. After entering the tubing string 106, the production fluid may flow to the surface. Alternatively, fluid may flow in the opposite direction.

In some cases, operators may run a line (such as a power or control line) along the outside of one or more screens 102. To hold the line in place, some traditional line capture devices may be affixed to a heavy screen. Lighter screens (such as the screen 102) may not be suitable to support traditional line capture devices. Other traditional line capture devices may be sandwiched between two screens while also clamping on the tubing string 106. Such traditional line capture devices interrupt flow through the annular space 108 because they do not include fluid passages. Therefore, traditional line capture devices may be incapable of coupling multiple screens to increase flow into the ICD 104. Hence, traditional production equipment may have limited flow into ICDs or may require more ICDs to increase production.

Some implementations include fluted rings that effectuate flow, couple screens 102 on the tubing string 106, capture a line (such as a power or control line) running along the outside of the screens 102, and centralize the screens in the wellbore. The fluted rings may enable operators to couple any suitable number of screens together to form a suitably sized inlet that flows into and out of the tubing string 106. Hence, some implementations may be used to join a plurality of screens to increase flow while also capturing a downhole line running along the screens. Additionally, some implementations of the fluted rings may include centralizers that position the screens in the wellbore. Hence, some implementations may eliminate the need for centralizers typically used with modular screens. These and other aspects are described in greater detail below.

Example Implementations

Figure 2:
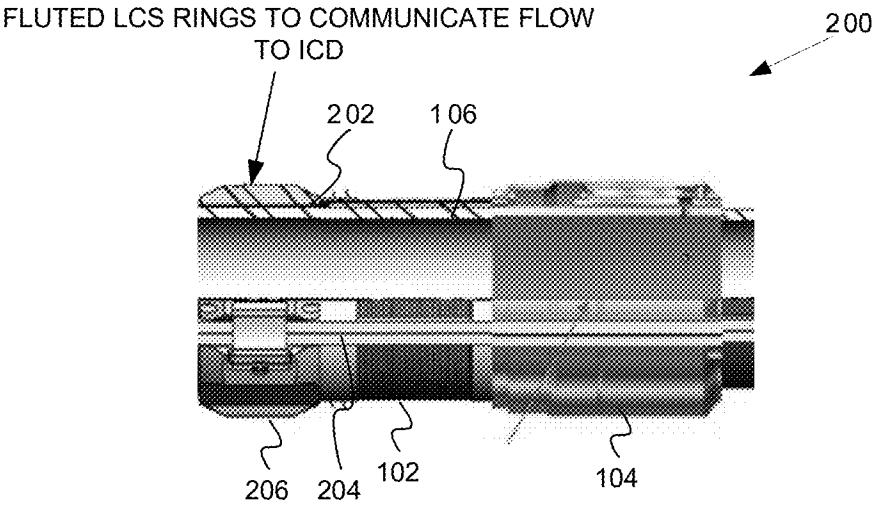
FIG. 2 is a cut away view of a completion string including the fluted rings.

FIG. 2 is a cut away view of a completion string 200 including a ring 202. In FIG. 2, the ring 202 may be coupled with one or more screens 102 and may capture a line 204. The ring 202 may include flutes that allow fluid to flow toward or away from the ICD 104. That is, fluid in the annular space between the screen 102 and tubing string 106 may pass through the ring 202. The ring 202 may capture the line 204 as it passes along the completion string 200. The ring 202 also may include one or more ribs 206 that centralize the screens 102 in the wellbore.

Figure 3:
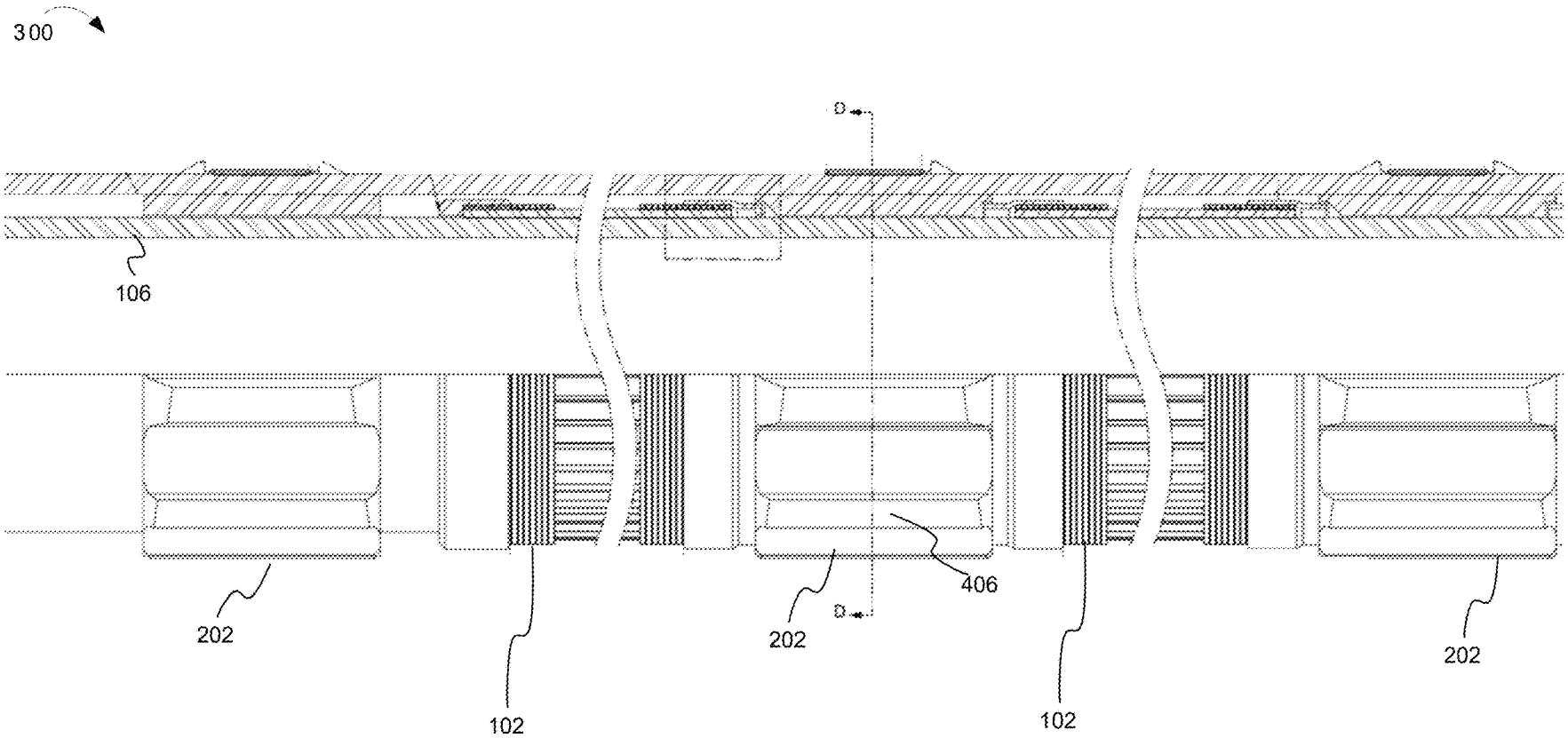
FIG. 3 is a longitudinal section of a production string including rings.

FIG. 3 is a longitudinal section view of a completion string 300 including rings 202. As shown, the rings 202 and screens 102 may envelop the tubing string 106. The rings 202 may include flutes 406 that enable formation fluid to pass through.

Figure 4:
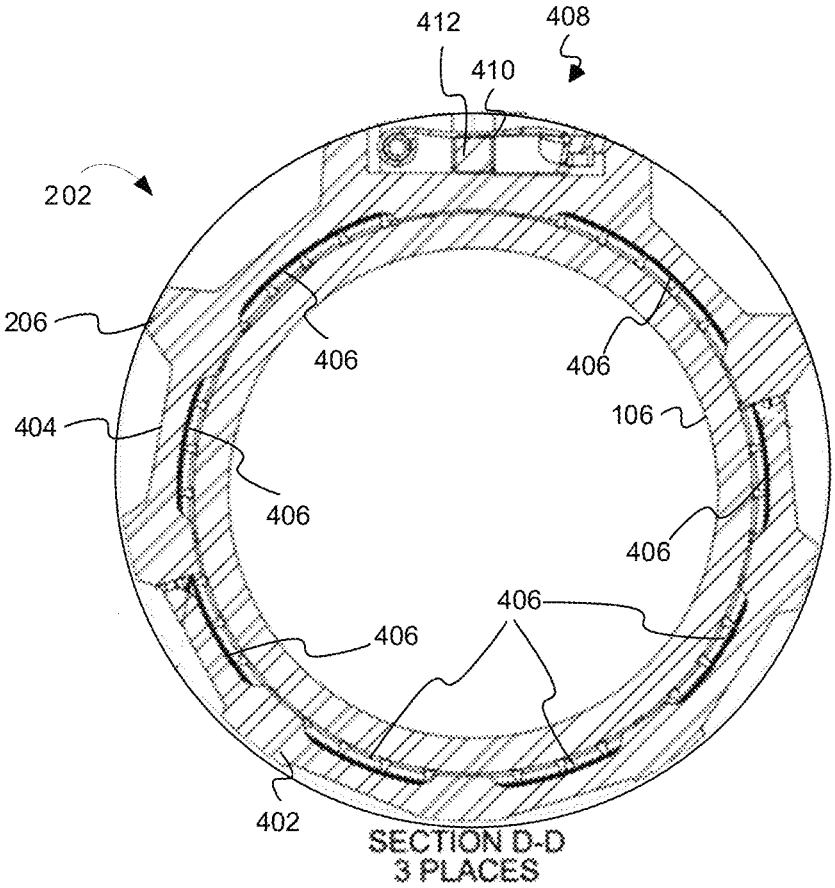
FIG. 4 is a section view of a ring in the completion string.

FIG. 4 is a section view (section D-D of FIG. 3) of a ring 202 in the completion string 300. As shown, the flutes 406 form passages for fluid to pass through the ring 202. As the fluid passes through the ring 202, it may pass into an annular space between an adjacent screen 102 and the tubing string 106. Alternatively, the formation fluid may pass through the ring 202 into an ICD 104 or elsewhere.

In some implementations, the ring 202 may include two or more pieces (such as 404 and 402) configured to join together. The ring 202 also may include a line channel 412 to accommodate the line 204. The ring 202 also may include a line retainer for capturing a line. The line retainer may be implemented as any suitable device such as the clip 410. The clip 410 may be hinged and include a latch or other device to secure the clip 410 in a closed position. The clip 410 may include any suitable components that effectuate capture of the line 204.

The ring 202 also may include one or more ribs 206 to centralize the ring 202 and screens 102 in a wellbore.

Figure 5:
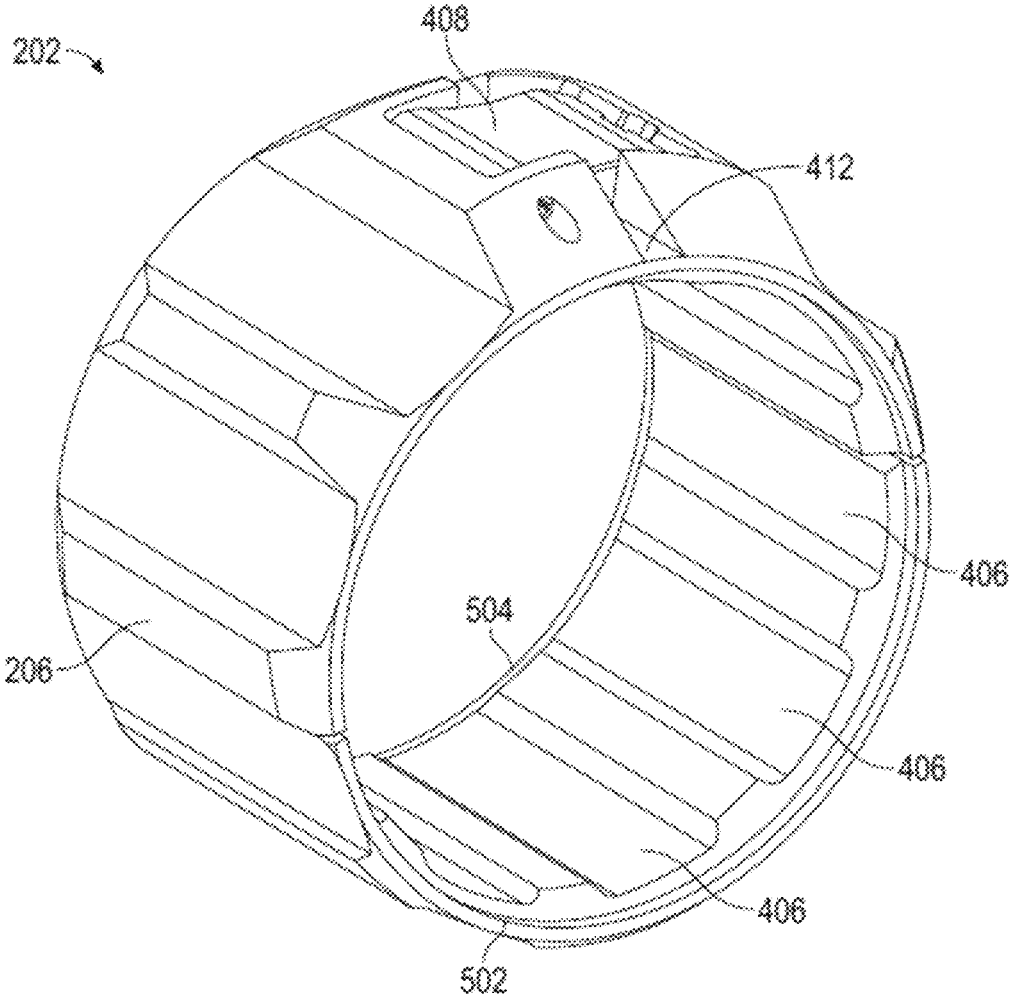
FIG. 5 is a perspective view of the ring.

FIG. 5 is a perspective view of the ring 202. The ring 202 may include the flutes 406, clip 408, line channel 412. The ring also may include the ribs 206.

The ring 202 may include a screen interface at each end (see screen interfaces 502 and 504). Each screen interface is configured to be coupled with a screen 102. As noted, the flutes 406 may effectuate flow through the ring 202.

Figure 6:
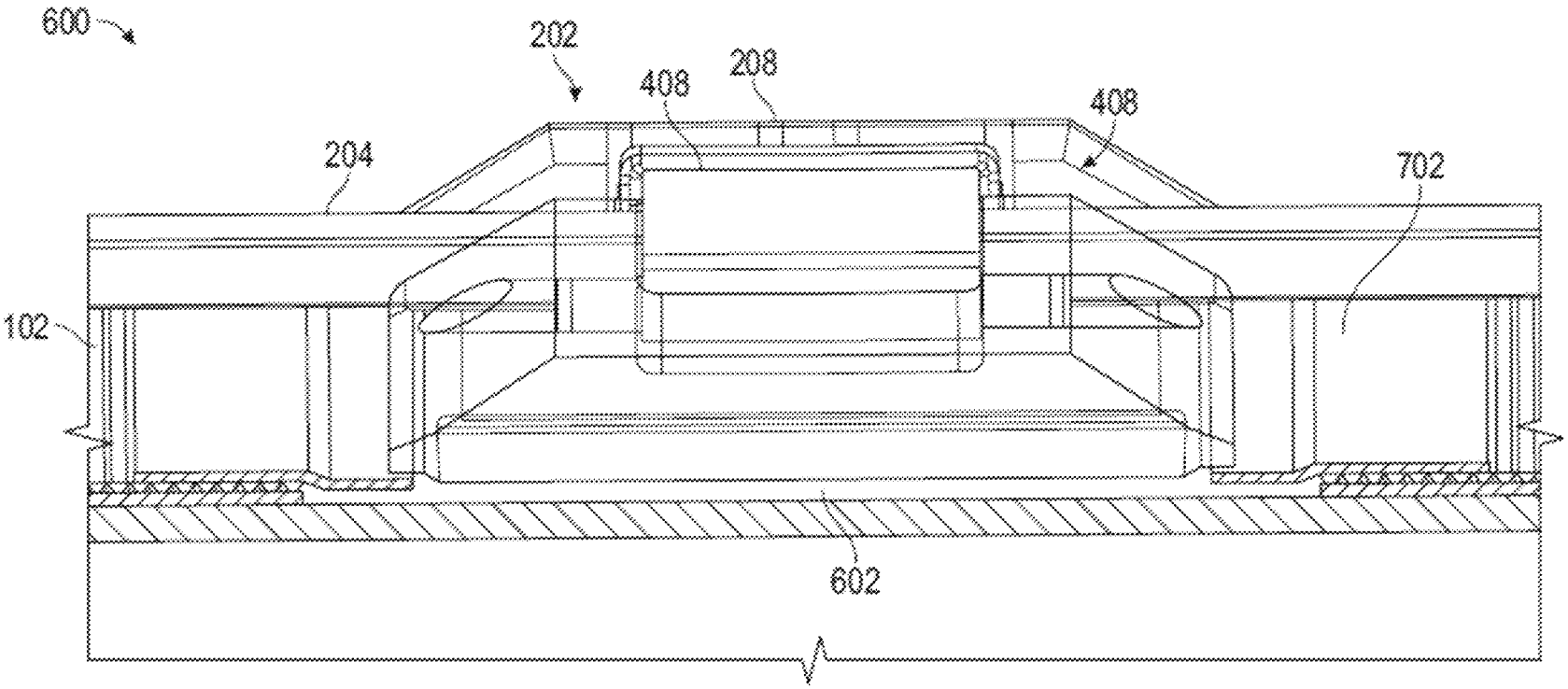
FIG. 6 is a close-up view of a production string.

FIG. 6 is a close-up view of a completion string 600. As shown, the ring 202 may include the ribs 206 to enable the ring 202 to function as a centralizer. The ring 202 also may include the clip 408, line channel 412, and flutes (not shown)

that create an axial flow path through the ring 202. The line 204 is captured by the clip 408 and resides in the line channel 412. The ring 202 may be coupled with sealing rings 702 or directly with screens 102.

Example Well System

Figure 7:
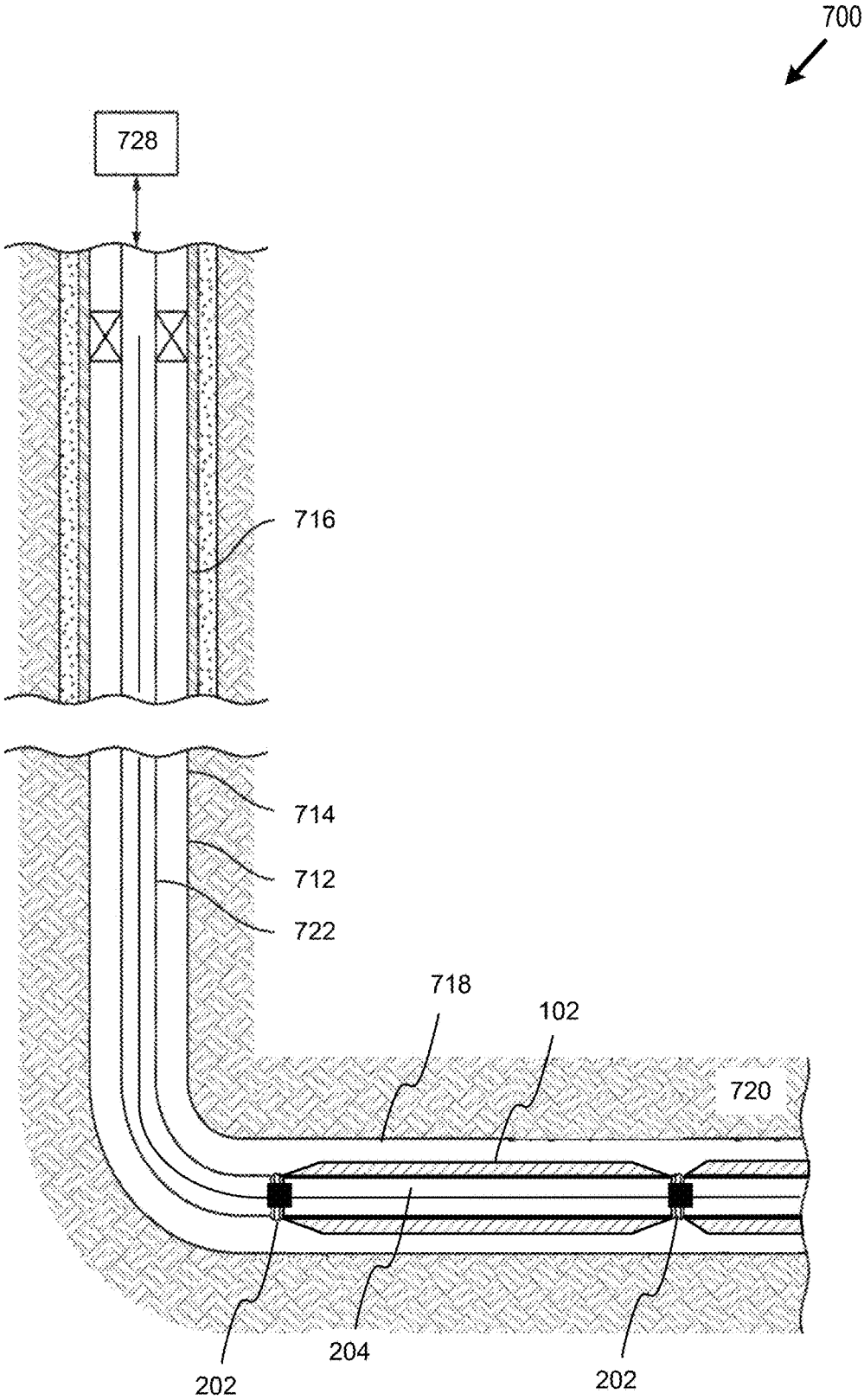
FIG. 7 is a cross-sectional diagram depicting an example well system including rings.

Implementations may be used in any suitable variation of downhole activity. For example, some implementations of the ring 202 (and any other component described herein) may be utilized in connection with a well system. FIG. 7 is a cross-sectional diagram depicting an example well system 700 including rings 202. The well system 700 may comprise a wellbore 712 which intersects a subsurface formation 720. The wellbore 712 may include a vertical section 714 (which is at least partially cemented with a casing string 716) and a horizontal section 718. The horizontal section 718 may be an open-hole section of the wellbore 712. Any suitable wellbore configuration may also be utilized.

Positioned within the wellbore 712 and extending from the surface is a tubing string 722 which provides a conduit for formation fluids to travel from the subsurface formation 720 to the surface and for stimulation fluids to travel from the surface to the subsurface formation 120. The tubing string 722 may include one or more screens 102 couple via rings 202. The rings 202 may capture the line 204. The screens 102 and rings 202 may provide an axial flow path into and out of an ICD (not shown in FIG. 7). Although not shown in FIG. 7, there may be additional line capture devices for holding the line 204 along sections of the tubing sting 722 that do not include screens 102.

The well system 700 may further comprise surface equipment 728. The surface equipment 728 may comprise a wellhead, a choke, one or more production vessels, a power generator, a compressed air unit, and other items of equipment.

FIGS. 1-7 and the operations described herein are examples meant to aid in understanding example implementations and should not be used to limit the potential implementations or limit the scope of the claims.

As used herein, a phrase referring to "at least one of" a list of items refers to any combination of those items, including single members. As an example, "at least one of: a, b, or c" is intended to cover: a, b, c, a-b, a-c, b-c, and a-b-c.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be removed from the combination, and the claimed combination may be directed to a subcombination or variation of a subcombination.

Implementations may be characterized by the following clauses:

Clause 1: A downhole line capture device for use in a wellbore comprising: a ring including one or more flutes configured to enable fluid to flow axially through an annular space between the ring and a tubular; and a line retainer coupled with the ring to capture a line running along an outer surface of the ring.

Clause 2: The implementation of clause 1, wherein one or more supports inside the ring form each flute.

Clause 3: The implementation of any one or more of clauses 1-2, wherein the ring further includes ribs configured to centralize the one or more screens in the wellbore.

Clause 4: The implementation of any one or more of clauses 1-3, wherein the ring further includes a cavity to accommodate the line, and wherein the clip further includes a plate hinged to the ring and configured to capture the line in the cavity.

Clause 5: The implementation of any one or more of clauses 1-4, wherein the ring includes a plurality of curved ring elements configured to couple together to form the ring.

Clause 6: The implementation of any one or more of clauses 1-5, wherein the line is an electrical cable, telecommunications cable, or a mechanical cable.

Clause 7: The implementation of any one or more of clauses 1-6, wherein the flutes are positioned about an inner circumference of the ring.

Clause 8: A downhole line capture system comprising: downhole line capture device including a ring including one or more flutes configured to enable fluid to flow axially through an annular space between the ring and a tubular, a line retainer coupled with the ring to capture a line running along an outer surface of the ring; and one or more screens configured to be coupled with the line capture device.

Clause 9: The implementation of clause 8, wherein the flutes are formed by one or more supports residing on an inner surface of the ring.

Clause 10: The implementation of any one or more of clauses 8-9 further including an inflow control device coupled with one of the screens.

Clause 11: The implementation of any one or more of clauses 8-10, wherein the ring further includes ribs configured to centralize the one or more screens in a wellbore.

Clause 12: The implementation of any one or more of clauses 8-11, wherein the ring further includes a cavity to accommodate the line, and wherein the clip further includes a plate hinged to the ring and configured to capture the line in the cavity.

Clause 13: The implementation of any one or more of clauses 8-12, wherein the ring includes a plurality of curved ring elements configured to couple together forming the ring.

Clause 14: The implementation of any one or more of clauses 8-13, wherein the line is an electrical cable, telecommunications cable, or a mechanical cable.

Clause 15: The implementation of any one or more of clauses 8-14, wherein the flutes are positioned about an inner circumference of the ring.

Clause 16: A method comprising: inserting a downhole line capture device into a wellbore, the line capture device including a ring including one or more flutes configured to enable fluid to flow axially through an annular space between the ring and a tubular, a line retainer coupled with the ring to capture a line running along an outer surface of the ring; and inserting the line into the clip.

Clause 17: The implementation of clause 16, further comprising: coupling the ring with the one or more screens; coupling at least one of the screens to an inflow control device.

Clause 18: The implementation of any one or more of clauses 16-17, wherein the ring further includes ribs configured to centralize the one or more screens in a wellbore.

Clause 19: The implementation of any one or more of clauses 16-18, wherein the ring further includes a channel to accommodate the line, and wherein the clip further includes a plate hinged to the ring and configured to capture the line in the channel.

Clause 20: The implementation of any one or more of clauses 16-19, wherein the ring includes a plurality of curved ring elements configured to couple together forming the ring.

What is claimed is:

1. A downhole line capture device for use in a wellbore comprising:

a ring including one or more flutes positioned about an inner circumference of the ring, the flutes configured to enable fluid to flow axially through an annular space between the ring and a tubular; and a line retainer coupled with the ring to capture a line running along an outer surface of the ring.

2. The downhole line capture device of claim 1, wherein one or more supports inside the ring to form each flute.

3. The downhole line capture device of claim 1, wherein the ring further includes ribs configured to centralize the ring in the wellbore.

4. The downhole line capture device of claim 1, wherein the ring further includes a cavity to accommodate the line, and wherein the line retainer further includes a plate hinged to the ring and configured to capture the line in the cavity.

5. The downhole line capture device of claim 1, wherein the ring includes a plurality of curved ring elements configured to couple together to form the ring.

6. The downhole line capture device of claim 1, wherein the line is an electrical cable, telecommunications cable, or a mechanical cable.

7. A downhole line capture system comprising:

downhole line capture device including a ring including one or more flutes positioned about an inner circumference of the ring and configured to enable fluid to flow axially through an annular space between the ring and a tubular, a line retainer coupled with the ring to capture a line running along an outer surface of the ring; and one or more screens configured to be coupled with the downhole line capture device.

8. The downhole line capture system of claim 7, wherein the flutes are formed by one or more supports residing on an inner surface of the ring.

9. The downhole line capture system of claim 7 further including an inflow control device coupled with one of the screens.

10. The downhole line capture system of claim 7, wherein the ring further includes ribs configured to centralize the one or more screens in a wellbore.

11. The downhole line capture system of claim 7, wherein the ring further includes a cavity to accommodate the line, and wherein the line retainer further includes a plate hinged to the ring and configured to capture the line in the cavity.

12. The downhole line capture system of claim 7, wherein the ring includes a plurality of curved ring elements configured to couple together forming the ring.

13. The downhole line capture system of claim 7, wherein the line is an electrical cable, telecommunications cable, or a mechanical cable.

14. A method comprising:

inserting a downhole line capture device into a wellbore, the line capture device including a ring including one or more flutes positioned about an inner circumference of the ring and configured to enable fluid to flow axially through an annular space between the ring and a tubular, a line retainer coupled with the ring to capture a line running along an outer surface of the ring; and inserting the line into the line retainer.

15. The method of claim 14 further comprising:

coupling the ring with one or more screens;

coupling at least one of the screens to an inflow control device.

16. The method of claim 14, wherein the ring further includes ribs configured to centralize one or more screens in the wellbore, wherein the one or more screens are connected to the downhole line capture device.

17. The method of claim 14, wherein the ring further includes a channel to accommodate the line, and wherein the line retainer further includes a plate hinged to the ring and configured to capture the line in the channel.

18. The method of claim 14, wherein the ring includes a plurality of curved ring elements configured to couple together forming the ring.

* * * * *